US006687959B2

(12) United States Patent
Kageyama et al.

(10) Patent No.: US 6,687,959 B2
(45) Date of Patent: Feb. 10, 2004

(54) CLIP ATTACHING STRUCTURE

(75) Inventors: Toshihiko Kageyama, Kawagoe (JP); Hidehei Kageyama, Kawagoe (JP); Yoshio Noguchi, Kawagoe (JP); Sachio Arai, Kawagoe (JP)

(73) Assignee: Kotobuki and Co., Ltd., Kyoto (JP)

( * ) Notice: Subject to any disclaimer, the term of this patent is extended or adjusted under 35 U.S.C. 154(b) by 0 days.

(21) Appl. No.: 10/243,937

(22) Filed: Sep. 16, 2002

(65) Prior Publication Data

US 2003/0056336 A1 Mar. 27, 2003

(30) Foreign Application Priority Data

Sep. 25, 2001 (JP) ..... 2001-292623
Sep. 25, 2001 (JP) ..... 2001-292624

(51) Int. Cl.[7] ..... B43K 25/00

(52) U.S. Cl. ..... 24/10 R; 24/11 R; 24/11 F; 24/11 M; 24/11 PP; 401/104; 401/131

(58) Field of Search ..... 24/10 R, 11 R, 24/11 F, 11 M, 11 P, 11 PP; 401/131, 104, 50

(56) References Cited

U.S. PATENT DOCUMENTS 1,490,231 A * 4/1924 Poole ..... 24/11 M
2,555,985 A * 6/1951 Merryman ..... 24/11 F
3,842,466 A 10/1974 Katz et al.
4,516,869 A 5/1985 Corpataux
4,790,678 A * 12/1988 Araki ..... 401/104
5,570,965 A * 11/1996 Coolen ..... 401/98
6,257,787 B1 * 7/2001 Kirk ..... 401/104

FOREIGN PATENT DOCUMENTS

EP 0 319 311 6/1989
EP 1 010 545 A1 6/2000
WO WO 85/03038 7/1985

* cited by examiner

*Primary Examiner*—Victor Sakran
(74) *Attorney, Agent, or Firm*—McGinn & Gibb, PLLC

(57) ABSTRACT

It is a clip attaching structure wherein the cost can be reduced, and the appearance is excellent, and furthermore, the spring action is good. The clip is made of a thin plate metal material, and has a base part to be inserted into an outer sleeve and a main body part to be extended outside the outer sleeve, and the main body part has an approximately U-shaped cross section made by bending downward both sides of the thin plate, and between the base part and the main body part, a closing part for closing the rear end opening of the inner sleeve is provided. The main body part side of the closing part has an approximately U-shaped cross section made by downward bending both sides thereof and the approximately U-shaped cross section from the main body part is continued, and the base part side of the closing part is shaped like a plate, and the downward bent portion of both sides of the closing part is inserted into the inner sleeve when the clip is not swung.

2 Claims, 12 Drawing Sheets e
26c
26a
26d
26a
26b
26b
b
b
d
c
c

CLIP ATTACHING STRUCTURE

BACKGROUND OF THE INVENTION

1. Field of the Invention

The present invention relates to a clip attaching structure for attaching a clip to an outer casing of a writing instrument or the like.

2. Description of the Related Art

The clip attached to the outer casing is used for holding the outer casing of a writing instrument or the like at a pocket or paper or the like, when carrying them, and it is exposed to the outside of the outer casing. Therefore, the exterior of the clip is an important factor for dominating the total appearance. For example, in the case where the clip is made of a thick plate material, the feeling of quality is higher than that in the case where the clip is made of a thin plate material, which is preferable.

On the other hand, when the clip is made of a thick plate material, the soft elasticity is lost, and therefore, it becomes unsuitable for the original use as a clip. Therefore, conventionally, as shown in FIG. 12, a structure in which the spring action of the clip is compensated by using a spring separately is well known. In FIG. 12, a clip 42 has a base part 42*a* to be inserted into an outer casing 40 and a clip main body 42*b* extending approximately in parallel with the outer casing 40. The base part 42*a* is inserted into the outer casing 40 from a lateral hole formed in the side of the outer casing 40. Furthermore, at the end part of the outer casing 40, a screw shaft 44*a* of a breechblock 44 is screwed, and the tip of the screw shaft 44*a* is loosely passing through the base part 42*a* to prevent the base part 42*a* from displacing a center of the outer casing 40. Furthermore, in the outer casing 40, a partition wall 46 is fixed by pressing or the like, and between the partition wall 46 and the base part 42*a*, a spring 48 is disposed, and the above described spring 48 is always urges the base part 42*a* to the end part of the outer casing 40.

When the clip 42 composed as described above, as shown by the imaginary line in the figure is swung around the point near the base part 42*a*, by the tip of the clip main body 42*b* being raised to be separated from the outer casing 40, the base part 42*a* is inclined against a spring force of the spring 48, and a clearance is formed between the clip main body 42*b* and the outer casing 40. The clip 42 itself is hardly deformed and only the spring 48 is deformed, and therefore, a lot of swinging amounts can be obtained by a comparatively little force, even if a large force is not applied to the clip main body 42*b*. When the force to the clip main body 42*b* is released, the base part 42*a* is pressed onto the end part of the outer casing 40 by the spring force of the spring 48 to release the inclination, and therefore, the clip main body 42*b* returns to the original state where it approaches the outer casing 40.

However, in the case of the above described conventional structure like this, the problem is that a part of the spring 48 is necessary and the number of parts is increased and the assembling becomes complicated and consequently, the cost is raised. Moreover, the problem is that the cost of materials is increased since the clip is made of a thick plate material.

Furthermore, conventionally, it is sometimes necessary to attach an inner sleeve as one part to the inside of the outer sleeve. In such a case, there are well-known methods for attaching the inner sleeve to the outer sleeve, such as a method by screwing or bonding. In the case of screwing, a female screw is formed on the inside peripheral surface of the outer sleeve and a male screw is formed on the outside peripheral surface of the inner sleeve so that the male screw of the inner sleeve is screwed into the female screw of the outer sleeve. In the case of bonding, liquid or gel adhesives are coated onto the outside peripheral surface of the inner sleeve and the inner sleeve is inserted into a proper position in the outer sleeve and after that, the adhesives are hardened and fixed.

However, in the case of screwing, the outer sleeve and the inner sleeve must have such a relation allowing a relative rotation between them, and on the other hand, the relative rotation between them must be prohibited during using in order to prevent a careless detachment, and therefore, the problem is that a range of applications for the screwing method is limited. If a screw or the like cannot be formed on the outer sleeve or the inner sleeve, application for the screwing method is impossible.

On the other hand, in the case of liquid or gel bonding, it takes a lot of time to be dried and completely hardened, and it is also necessary to perform the work carefully so that the adhesives are not attached to other members, and therefore, the problem is that the working efficiency is bad.

SUMMARY OF THE INVENTION

In view of the foregoing and other drawbacks, disadvantages and problems of the conventional methods and structures, a first object of the present invention is to provide a clip attaching structure wherein the cost can be reduced and the appearance is good and furthermore, a good spring action is provided.

Another object of the present invention is to provide an attaching method for attaching an inner sleeve to an outer sleeve and an attaching structure of an inner sleeve to an outer sleeve wherein the application range is wide and the working efficiency is good.

In order to achieve the above described object, a clip attaching structure for attaching a clip to an outer casing of a writing instrument or the like according to the present invention comprises the outer casing and the clip made of a thin plate metal material. The clip includes a base part to be inserted into the outer casing, a clip main body part to be extended outside the outer casing and a middle portion provided between the base part and the clip main body part. The clip main body part has an approximately U-shaped cross section made by bending both sides of the thin plate, a clip main body part side of the middle portion has an approximately U-shaped cross section made by bending both sides thereof and continuing the approximately U-shaped cross section from the clip main body part, a base part side of the middle portion is shaped like a plate, and the downward bent portion of both sides of the middle portion is inserted into the outer casing when the clip is not swung.

This clip can be made at a low cost since it is made of a thin plate metal material, and in spite of that, the clip main body part exposed from the outer casing has an approximately U-shaped cross section made by bending both sides of the thin plate, and moreover, the bent portion of both sides of the middle portion is inserted into the outer casing in the state where the clip is not swung, and therefore, the boundary between the portion with an approximately U-shaped cross section of the middle portion and the portion shaped like a plate is not seen from the outside, and therefore, it can have an appearance equal to that of a clip which is made of a thick plate material.

Furthermore, when the clip is swung, the portion on the base part side shaped like a plate of the above described middle portion is the center of swing, and therefore, a good spring action can be provided, and the swinging operation of the clip can be performed by a comparatively light operating force. It is possible to hold the paper or the pocket easily between the clip main body part and the outer casing.

The middle portion can be arranged to close the rear end surface of the outer casing. Consequently, the downward bent portion of both sides of the middle portion can surely be contained in the outer casing.

Furthermore, a clip attaching structure for attaching a clip to an outer casing of a writing instrument or the like according to the present invention comprises the clip made of a thin plate metal material. The clip includes a base part to be inserted into the outer casing, a clip main body part to be extended outside the outer casing and a middle portion provided between the base part and the clip main body part, wherein the middle portion is arranged to close a rear end surface of the outer casing.

Since the rear end surface of the above described outer casing is closed by the middle portion, the clip can be attached to the outer casing with feeling of unity.

It is also possible that the rear end surface of the above described outer casing is an inclined surface inclined to an axial line, and that the base part of the above described clip is inserted into the same position in the circumferential direction as the rearmost position of the inclined rear end surface of said outer casing, and that the above described clip main body part is located at the same position in the circumferential direction as the foremost position of the inclined rear end surface. Consequently, the clip main body part can smoothly be continued from the middle portion.

In order to achieve the above described second object, an attaching method for attaching an inner sleeve to the inside of a cylindrical outer sleeve according to the present invention comprises the step of inserting the inner sleeve into the outer sleeve from an one end opening of the outer sleeve which has a slit formed therein and extending toward the one end from the other end thereof and at least the other end portion of the outer sleeve includes a tapered part having an inside diameter gradually reduced from the one end side to the other end. The inner sleeve includes a tapered part having an outside diameter following the inside diameter of the tapered part of the outer sleeve and an expanded diameter part located on the other end side of the tapered part of the inner sleeve and having an outside diameter larger than the inside diameter of the other end of the outer sleeve. The attaching method further comprises the steps of moving the expanded diameter part of the inner sleeve in the outer sleeve with forcibly widening the slit of the outer sleeve; and projecting the expanded diameter part from an other end opening of the outer sleeve to engage a step part formed between the expanded diameter part of the inner sleeve and the tapered part of the inner sleeve with an end surface of the other end opening of the outer sleeve.

Furthermore, an attaching structure for attaching an inner sleeve to an inside of a cylindrical outer sleeve according to the present invention, wherein the outer sleeve has a slit formed therein and extending toward an one end from the other end thereof, and at least the other end portion thereof includes a tapered part having an inside diameter gradually reduced from the one end side to the other end;

the inner sleeve includes a tapered part having an outside diameter following the inside diameter of the tapered part of the outer sleeve and an expanded diameter part located on the other end side of the tapered part of the inner sleeve and having an outside diameter larger than the inside diameter of the other end of the outer sleeve; and the inner sleeve is inserted into the outer sleeve from an one end opening of the outer sleeve, the expanded diameter part thereof passes through the outer sleeve with forcibly widening the slit of the outer sleeve to project from an other end opening of the outer sleeve, and a step part formed between the expanded diameter part of the inner sleeve and the tapered part of the inner sleeve is engaged with an end surface of the other end opening of the outer sleeve.

When inserting the inner sleeve into the outer sleeve, the expanded diameter part of the inner sleeve can be moved in the outer sleeve with forcibly expanding the outer sleeve in the outside diameter direction by utilizing the elasticity of the slit, and after the expanded diameter part has projected from the other end opening of the outer sleeve, the outer sleeve returns to the original state by the restoring force, and the tapered part of the inner sleeve fits to the tapered part of the outer sleeve, and the step part formed between the tapered part and the expanded diameter part is engaged with the end surface of the other end opening of the outer sleeve. Accordingly, it does not occur for the inner sleeve to slip easily off from the outer sleeve. Thus, the inner sleeve can be fixed to the outer sleeve basically only by the work of inserting the inner sleeve into the outer sleeve, and therefore, the inner sleeve can be attached to the outer sleeve with a good working efficiency and furthermore, with a good appearance of the outer sleeve. Even in the case of a structure where the inner sleeve cannot rotate relative to the outer sleeve, or even in the case where the inner sleeve or the outer sleeve is made of a material with no adhesion property, it can be applied, and the range of application can be widened.

The present disclosure relates to subject matter contained in Japanese Patent Application Nos. 2001-292623 and 2001-292624, filed on Sep. 25, 2001, which are expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Figure 1:
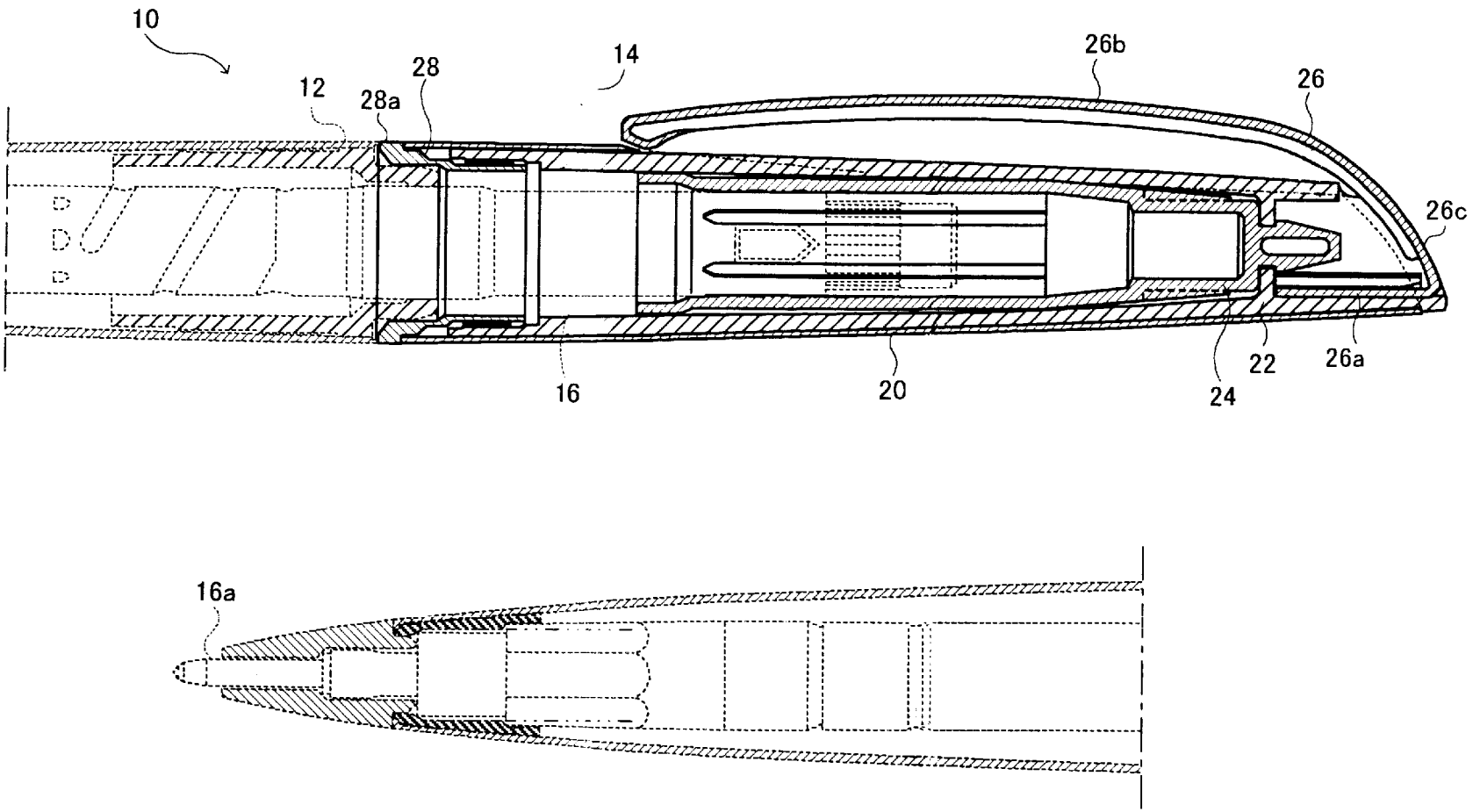
FIG. 1 is an overall longitudinal sectional view of an embodiment of a clip attaching structure of the present invention.

The preferred embodiments of the present invention will be described below by referring to the drawings. The present invention can be applied to an outer casing for the stationary, an outer casing for the cosmetics, or an outer casing of the data input pen or the like, however a case where the present invention is applied to a writing instrument as an example will be described hereafter.

FIG. 1 is an overall longitudinal sectional view showing an embodiment where the clip attaching structure of the present invention is applied to a cap 14 of a writing instrument 10.

The writing instrument 10 includes a writing instrument main body 12 and a cap 14 to be removably put onto the writing instrument main body 12. A refill 16 having a ball at the tip 16*a* and containing ink is assembled into the writing instrument main body 12.

The cap 14 has an outer casing mainly made of an outer sleeve 20, an inner sleeve 22, and an inner cap 24, all of which are shaped cylindrical, respectively. Furthermore, in the following description, for purposes of convenience, it is provided that the side to be connected to the writing instrument main body 12 is referred as the "front (tip)" side and the opposite side thereof is referred as the "rear" side. The inner sleeve 22 is fixed in the outer sleeve 20, and the inner cap 24 is fixed to the inner sleeve 22. To the rear end part of the outer casing, a clip 26 is fixed.

Figure 2A:
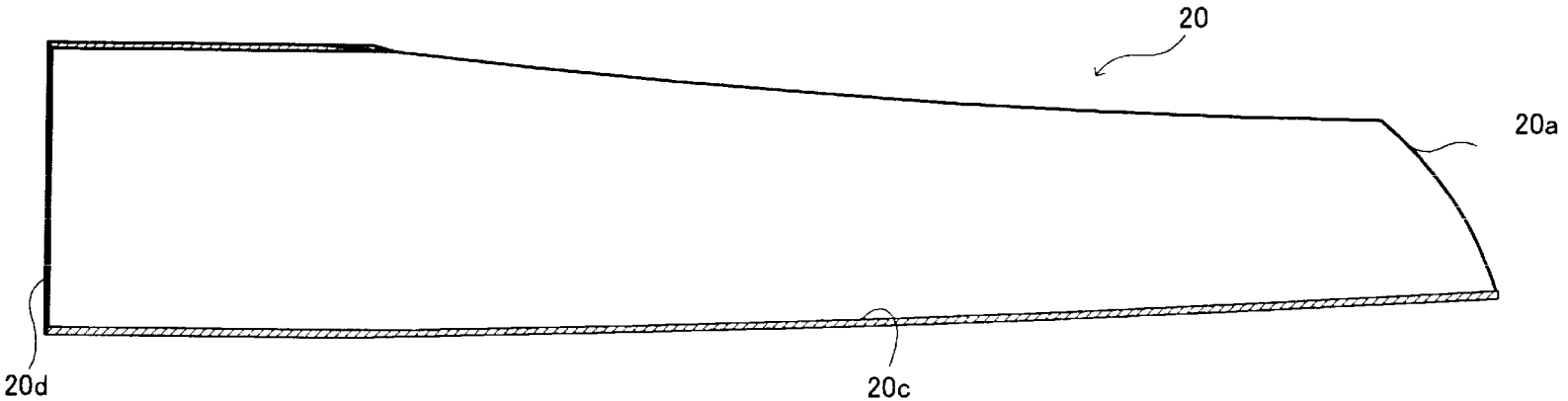
FIG. 2(*a*) is a longitudinal sectional view of an outer sleeve of FIG. 1, and FIG. 2(*b*) is a plan view of the outer sleeve.
Figure 2B:
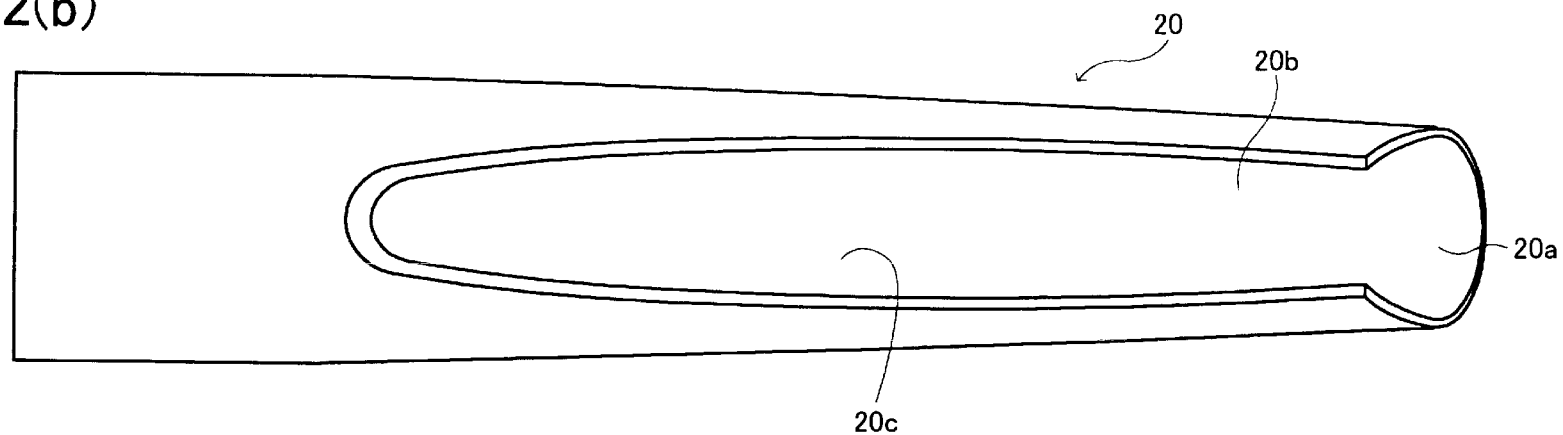

In this embodiment, the outer sleeve 20 is made of a metal and shaped like a thin cylinder. However, it is not limited to this, and it can be made of a synthetic resin. As shown in FIG. 2, the outer sleeve 20 is formed with a slit 20*b* extending forward from the rear end opening 20*a* thereof, and furthermore, the interior of the outer sleeve 20 is a tapered part 20*c* with an inside diameter gradually decreased from the front side to the rear end. The rear end opening 20*a* has an inclined surface inclined to an axial line, and the above described slit 20*b* is formed from the foremost position of the inclined rear end opening 20*a*.

Figure 3A:
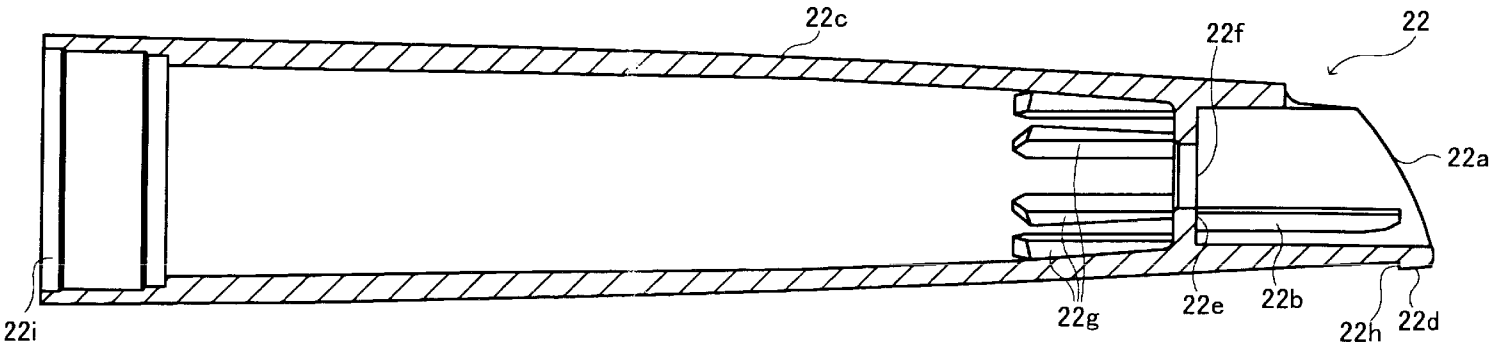
FIG. 3(*a*) is a longitudinal sectional view of an inner sleeve of FIG. 1, and FIG. 3(*b*) is a plan view of the inner sleeve, and FIG. 3(*c*) is a view shown along the arrow c of FIG. 3(*b*)
Figure 3B:
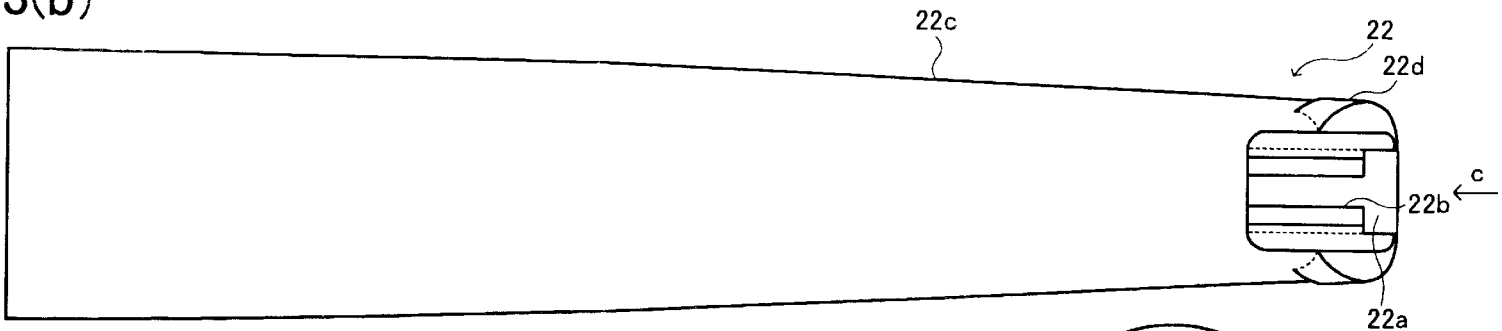
Figure 3C:
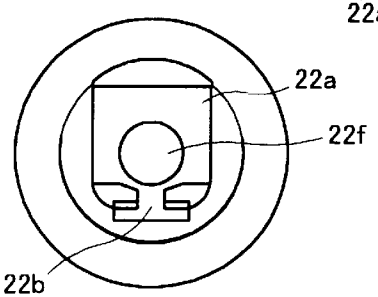

In this embodiment, the inner sleeve 22 is made of a synthetic resin and shaped cylindrical, and as shown in FIG. 3, the exterior thereof has a tapered part 22*c* which follows the tapered part 20*c* of the above described outer sleeve 20 and has an outside diameter gradually decreased to the rear end from the front side and an expanded diameter part 22*d* which is located at the rear end part behind the above described tapered part 22*c* and has a diameter expanded to be larger than that of the rear end part of the taped part 22*c*. The expanded diameter part 22*d* has an outside diameter larger than the inside diameter of the rear end of the above described outer sleeve 20. A partition wall 22*e* projecting in an inside diameter direction is formed at the rear part of the interior of the inner sleeve 22, and a through hole 22*f* is formed in the center of the partition wall 22*e*. A plurality of key grooves 22*g* are formed on the inner peripheral surface on the front side of the partition wall 22*e* of the inner sleeve 22. The rear end opening 22*a* of the inner sleeve 22 has also an inclined surface inclined to the axial line similarly to the rear end opening 20*a* of the above described outer sleeve 20, and a fitting groove 22*b* for receiving a base part 26*a* of the clip 26 to be described later is formed at the same position in a circumferential direction as the rearmost position of the inclined rear end opening 22*a*.

Figure 4A:
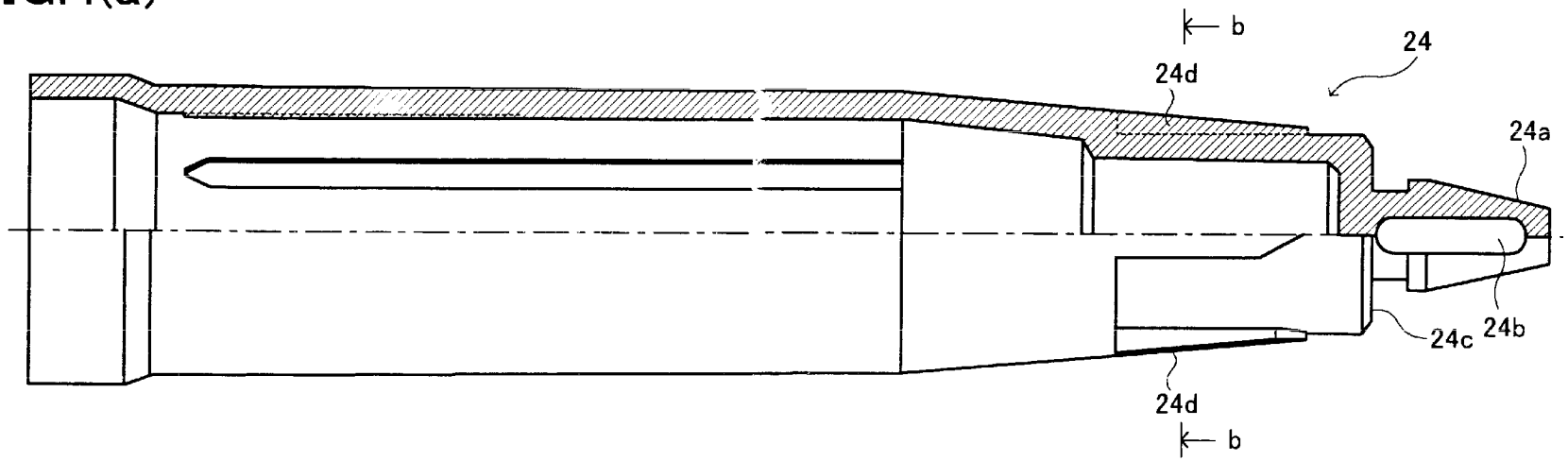
FIG. 4(*a*) is a semi longitudinal sectional view of an inner cap of FIG. 1, and FIG. 4(*b*) is an end view taken at b—b line of FIG. 4(*a*)
Figure 4B:
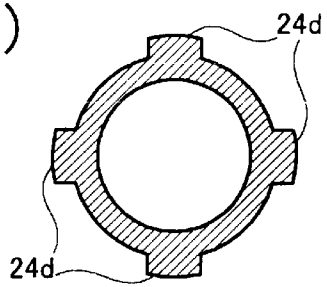

In this embodiment, the inner cap 24 is made of a synthetic resin and shaped like a cylinder, and is adapted to directly contact the tip part of the writing instrument 12. As shown in FIG. 4, a pointed head part 24*a* projecting rearward from the rear end surface 24*c* is formed at the rear end of the inner cap 24, and a lateral hole 24*b* passing through in a lateral direction perpendicular to the axial direction is formed in the pointed head part 24*a*. Furthermore, a plurality of keys 24*d* are formed on the outer peripheral surface in front of the pointed head part 24*a*.

The cap 14 further has a metal shell ring 28 as a decoration which is separate from the above described members, and the metal shell ring 28 is bonded to the inner peripheral surface at the tip of the inner sleeve 22. In this embodiment, the inner sleeve 22 and the metal shell ring 28 are made of separate members, however they are not limited to these, and it is also possible that the inner sleeve 22 and the shell ring 28 are made to be an integral member.

Figures 5A, 5B, 5C, 5D, 5E, 5F:
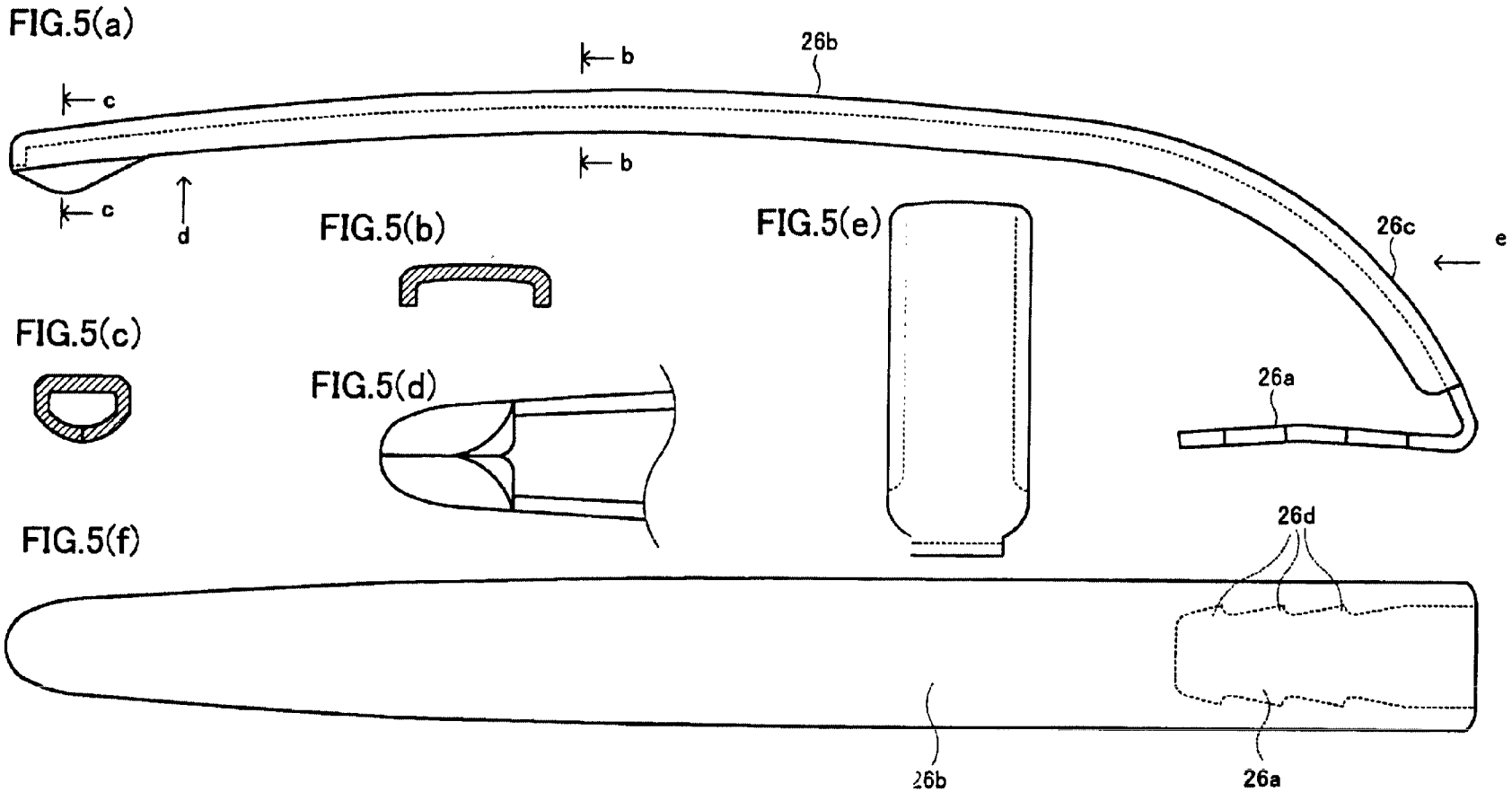
FIG. 5(*a*) is a side view of a clip of FIG. 1, and FIG. 5(*b*) is an end view taken at b—b line of FIG. 5(*a*), and FIG. 5(*c*) is an end view taken at c—c line of FIG. 5(*a*), and FIG. 5(*d*) is a partial view shown along arrow d of FIG. 5(*a*), and FIG. 5(*e*) is a view shown along arrow e of FIG. 5(*a*), and FIG. 5(*f*) is a plan view of the clip.

The clip 26 has the base part 26*a* to be pressed into the fitting groove 22*b* formed in the inner sleeve 22 fixed to the outer sleeve 20, a main body part 26*b* extended in the axial direction along the outer sleeve 20 approximately in parallel with the outer sleeve 20, and a closing part (middle portion) 26*c* connecting the base part 26*a* and the main body part 26*b* and closing the rear end opening 22*a* of the inner sleeve 22. The clip 26 is made of a thin plate metal material, and in order to create a feeling of high quality, the main body part 26*b* has both sides of the thin plate bent downward, and in the view of the cross section (refer to FIG. 5(*b*)), it is approximately shaped like a U which directs upside down. Accordingly, when the main body part 26*b* is seen from the side, it presents an appearance as if it were made of a thick plate material. At the tip part of the main body part 26*b*, the tips of both sides of the approximately U-shaped cross section are furthermore extending to abut against each other, and the cross section is shaped like a D whose convex directs downward (refer to FIG. 5(*c*)).

The closing part 26*c* is continuously and smoothly connected to the main body part 26*b*, and accordingly, a portion on the main body part 26*b* side of the closing part 26*c* has an approximately U-shaped cross section similarly to the main body part 26*b*. A portion on the base part 26*a* side of the closing part 26*c* is not bent and not shaped approximately like a U, but it is shaped like a plate. The closing part 26*c* is inclined to the axial line so as to follow and close the rear end opening 22*a* which has the inclined surface, of the inner sleeve 22. Then, the main body part 26*b* is located at the front side of the inclined closing part 26*c*, and the base part 26*a* is located at the rear side of the inclined closing part 26*c*.

A plurality of teeth 26*d* are formed along the side of the base part 26*a* to ensure it to be pressed into the fitting groove 22*b*.

Before the clip 26 is attached to the outer casing, the inner sleeve 22 is first fixed to the outer sleeve 20 and the inner cap 24 is then fixed to the inner sleeve 22 so that the outer casing is assembled with these outer sleeve 20, inner sleeve 22, and inner cap 24. They can easily assemble and fixed by insertion of the parts.

Figure 6:
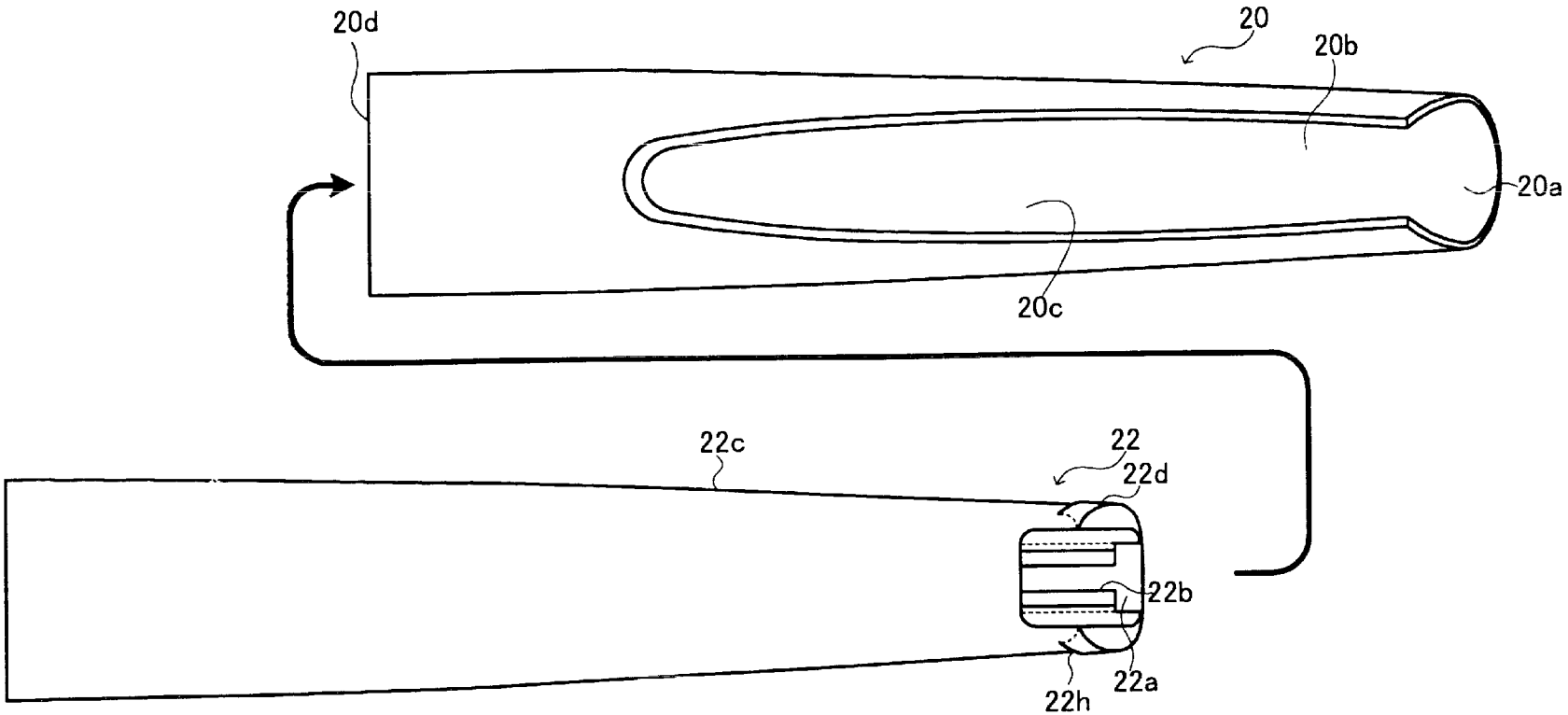
FIG. 6 is a view on a way when the inner sleeve is fixed to the outer sleeve.

Namely, as shown in FIG. 6, the inner sleeve 22 is first inserted from the front end opening 20*d* of the outer sleeve 20. Since the expanded diameter part 22*d* at the rear end part of the inner sleeve 22 becomes larger than the inside diameter of the tapered part 20*c* of the outer sleeve 20 as the inner sleeve 22 advances in the tapered part 20*c* of the outer sleeve 20, the inner sleeve 22 receives resistance from the outer sleeve 20. However, the slit 20*b* is formed in the outer sleeve 20, and therefore, the outer sleeve 20 can perform the elastic expanding displacement in the outside diameter direction by this slit 20*b*, and the expanded diameter part 22*d* can move in the outer sleeve 20 with forcibly widening the slit 20*b*.

Figure 7:
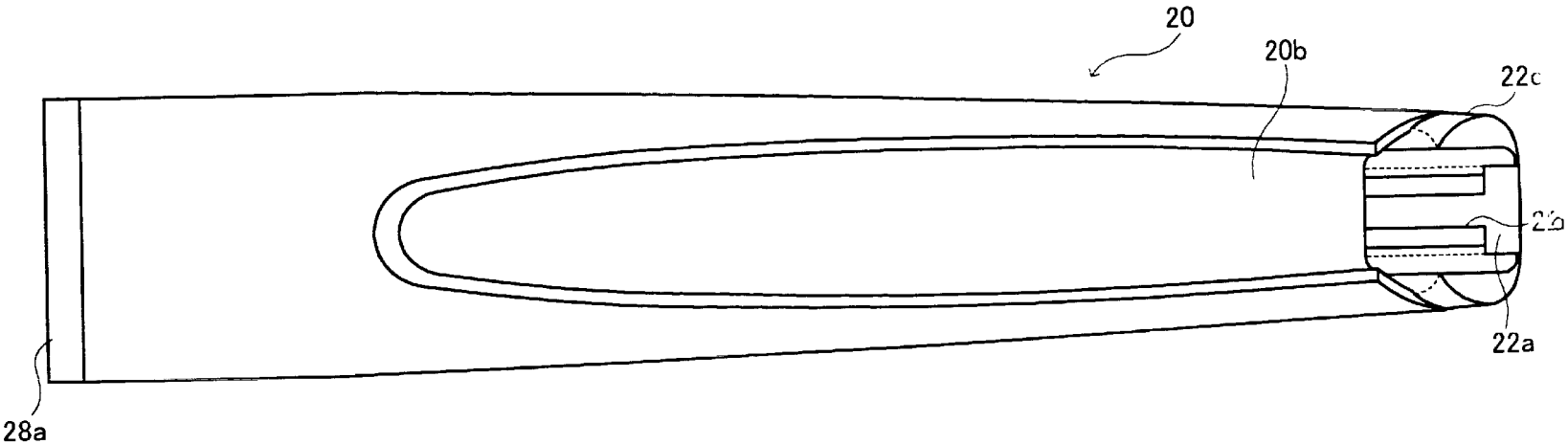
FIG. 7 is a view after the inner sleeve is fixed to the outer sleeve.

Then, when the expanded diameter part 22*d* of the inner sleeve 22 exits from the rear end opening 20*a* of the outer sleeve 20, the slit 20*b* is restored to the original state, and the tapered part 22*c* of the inner sleeve 22 fits the tapered part 20*c* of the outer sleeve 20, and the step part 22*h* formed between the tapered part 22*c* of the inner sleeve 22 and the expanded diameter part 22*d* is engaged with the end surface of the rear end opening 20*a* of the outer sleeve 20 (see FIG. 7). Since the tapered part 22*c* of the inner sleeve 22 fits the tapered part 20*c* of the outer sleeve 20, it is impossible for the inner sleeve 22 to furthermore move rearward, and since the step part 22*h* of the inner sleeve 22 is engaged with the end surface of the rear end opening 20*a* of the outer sleeve 20, it is also impossible for the inner sleeve 22 to move forward. Thus, the inner sleeve 22 is fixed to the outer sleeve 20 by the operation of insertion of the inner sleeve 22 into the outer sleeve 20 which is performed by utilizing the elasticity of the slit 20*b*, and therefore, the fixing can be performed with a good working efficiency.

Furthermore, if the metal shell ring 28 is bonded to the tip of the inner sleeve 22 and the tip collar part 28*a* widened in the outside diameter direction of the metal shell ring 28 is engaged with the tip of the outer sleeve 20, the outer sleeve 20 is held between the expanded diameter part 22*d* of the inner sleeve 22 and the tip collar part 28*a* of the metal shell ring 28 and therefore, the fixing of the inner sleeve 22 to the outer sleeve 20 can more surely be performed. As described above, the inner sleeve 22 and the metal shell ring 28 are separated and therefore, the inner sleeve 22 and the metal shell ring 28 are bonded, but in the case where both can be formed integrally, the time and labor can furthermore be saved. Furthermore, in this description, the procedure where the inner sleeve 22 is fixed to the outer sleeve 20 and after that, the metal shell ring 28 is bonded is explained, but it is also possible that the metal shell ring 28 is bonded to the inner sleeve 22 and after that, the inner sleeve 22 is fixed to the outer sleeve 20.

Figure 8:
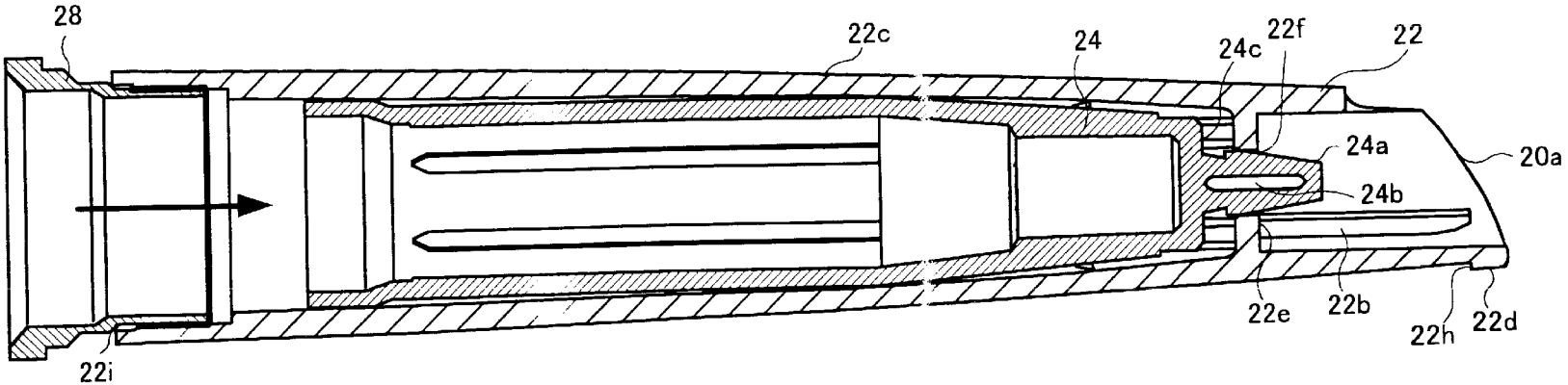
FIG. 8 is a view on a way when the inner cap is fixed to the inner sleeve, where the outer sleeve is omitted.

The inner cap 24 is then inserted from the front end opening 22*i* of the inner sleeve 22. Then, the key 24*d* of the inner cap 24 is fitted to the key groove 22*g* of the inner sleeve 22, and the rear end surface 24*c* of the inner cap 24 is brought into contact with the partition wall 22*e* of the inner sleeve 22, and the pointed head part 24*a* of the inner cap 24 is inserted into the through hole 22*f* formed in the partition wall 22*e* (see FIG. 8). At this moment, the pointed head part 24*a* is forced to pass through the through hole 22*f* with forcibly crushing the lateral hole 24*b* by utilizing the elasticity by the lateral hole 24*b*. After the pointed head part 24*a* has passed through the through hole 22*f*, the lateral hole 24*b* returns to the original shape by the restoring force thereof and the pointed head part 24*a* is engaged to the partition wall 22*e*. Thus, the operation of inserting the inner cap 24 into the inner sleeve 22 by utilizing the pointed head part 24*a* and the elasticity by the lateral hole 24*b* thereof allows the inner cap 24 to be fixed to the inner sleeve 22, and therefore, this work can also be performed with a good working efficiency, similarly to the fixing of inner sleeve 22 to the outer sleeve 20.

Next, the base part 26*a* of the clip 26 is pressed into the fitting groove 22*b* of the inner sleeve 22. At this moment, the base part 26*a* is surely pressed into the fitting groove 22*b* by the tooth 26*d* formed on the base part 26*a*.

Thus, when the base part 26*a* of the clip 26 is inserted into the fitting groove 22*b* of the inner sleeve 22 which exists at the position in the same circumferential direction as the rearmost position of the inclined surface of the rear end opening 22*a* of the inner sleeve 22, the closing part 26*c* of the clip 26 closes the rear end opening 22*a* along the inclined surface of the rear end opening 22*a* from the rearmost toward the foremost of the rear end openings 20*a* and 22*a* of the outer sleeve 20 and the inner sleeve 22. Then, the main body part 26*b* extends along the axial direction on the side of the outer sleeve 20 from the front of the rear end openings 20*a* and 22*a*. The main body part 26*b* is smoothly continued from the closing part 26*c* along the inclined surfaces of the rear end openings 20*a* and 22*a*.

Figure 9:
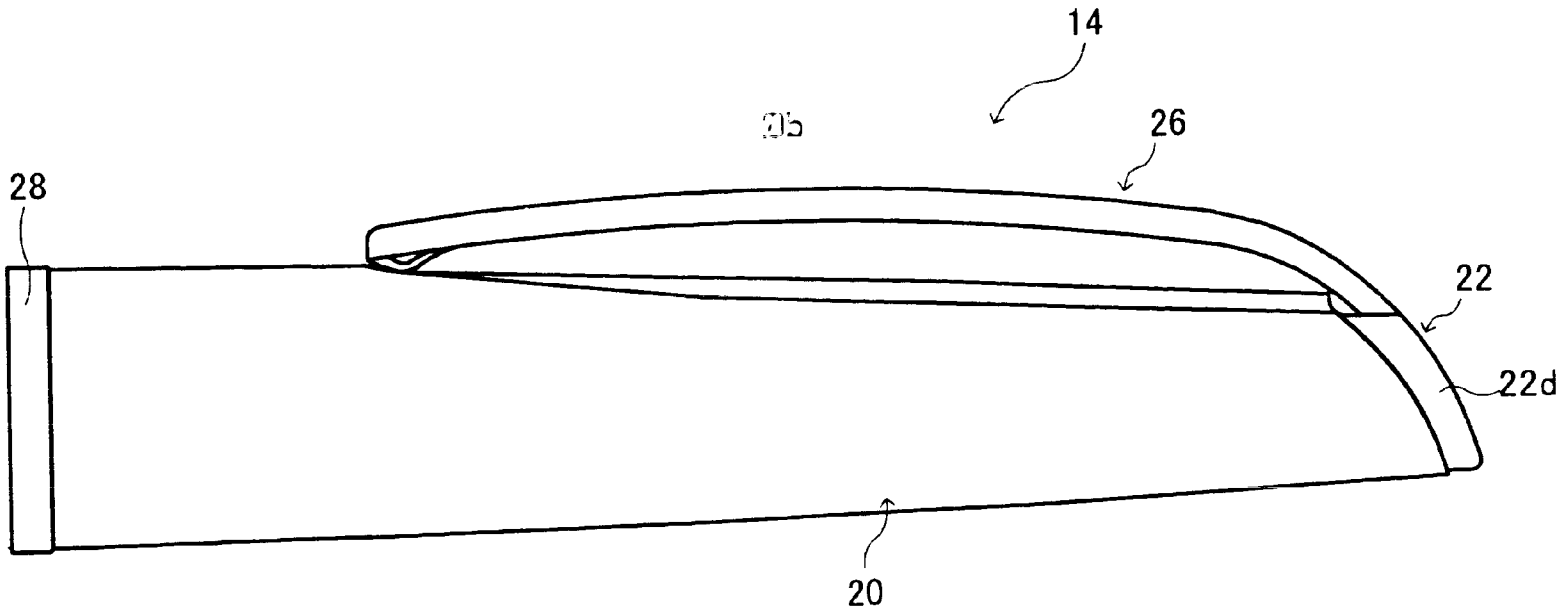
FIG. 9 is a view after the cap is assembled.
Figure 10:
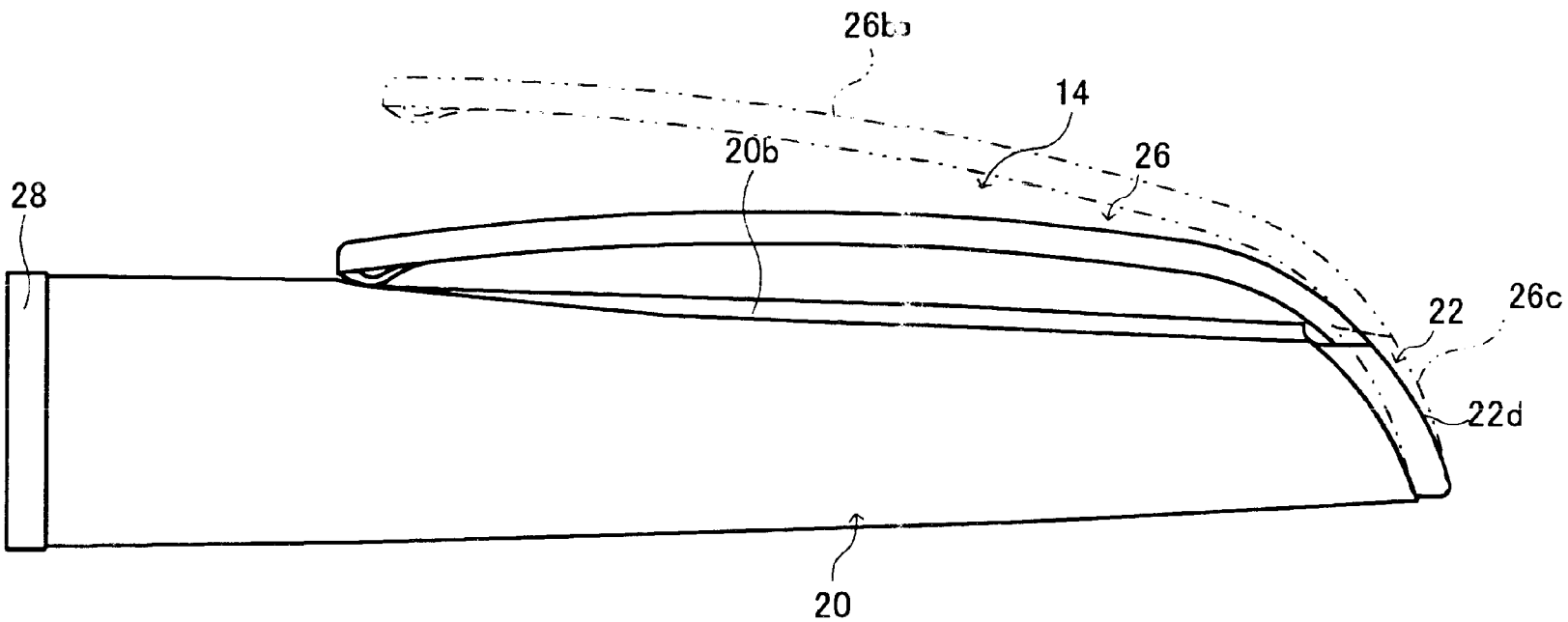
FIG. 10 is a side view of an embodiment of a clip attaching structure of the present invention.
Figure 11:
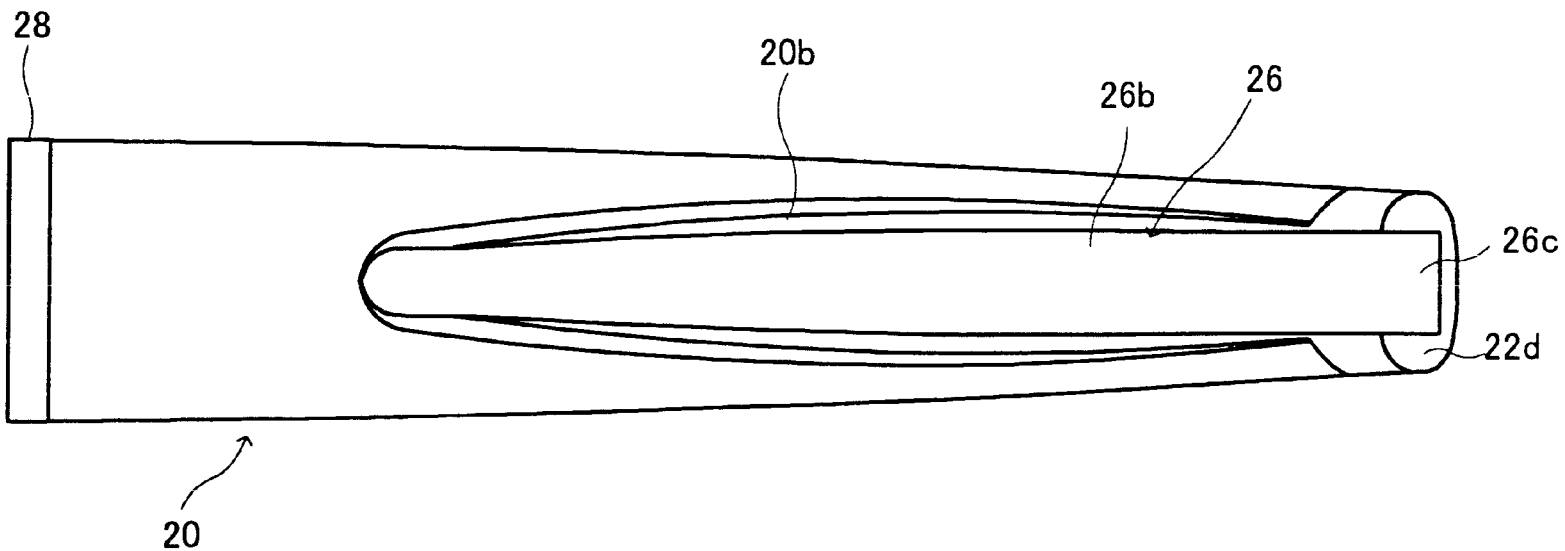
FIG. 11 is a plan view of the embodiment of the clip attaching structure of the present invention.
Figure 12:
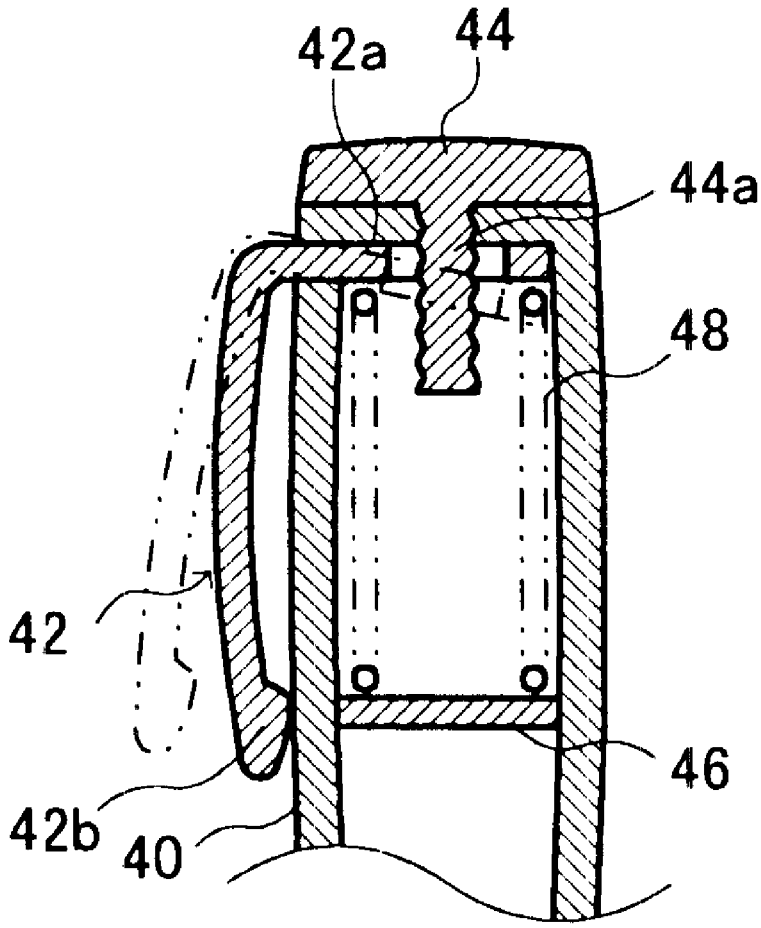
FIG. 12 is a longitudinal sectional view of a conventional clip attaching structure.

When the clip 26 is fixed to the outer sleeve 20, both sides of the portion with a cross section shaped approximately like a U by bending both sides of the closing part 26*c* are inserted into the inner sleeve 22 (refer to FIG. 9 to FIG. 11). Therefore, in the state where the clip is not swung, the boundary between the portion which is bent to have an approximately U-shaped cross section of the closing part 26*c* and the portion which is not bent to have an approximately U-shaped cross section cannot be seen from the outside. That is, as long as being seen from the outside, only both sides of the main body part 26*b* whose cross section is shaped approximately like a U can be seen when the clip is not swung, and therefore, it cannot be easily recognized that the clip is made of a thin plate, and it looks as if it were made of a thick plate material, and a good appearance can be obtained. Thus, the clip 26 is made of a thin plate material, and therefore, it can be made at a low cost differently from the case where it is made of a thick plate material.

Since the main body part 26*b* of the clip 26 is arranged at the sane position in the circumferential direction as the slit 20*b* of the outer sleeve 20, it can covers the slit 20*b*, and the slit 20*b* does not attract attention, and the total design is improved. However, it has such an effect that the design is furthermore improved by making part of the inner sleeve 22 seen through the slit 20*b* as one point. As mentioned above, the cap 14 can be manufactured by a simple work.

When the clip 26 is swung to hold the pocket or the paper between the clip 26 and the outer sleeve 20, it swings around the portion shaped like a plate of a thin plate which is not bent to be shaped approximately like a U in the closing part 26*c*, and the clip 26 can largely be swung with a little operating force (imaginary line in FIG. 10), and the operational performance is good.

While the invention has been described in terms of several preferred embodiments, those skilled in the art will recognize that the invention can be practiced with modification within the spirit and scope of the appended claims.

What is claimed is:

1. An attaching method for attaching an inner sleeve to an inside of a cylindrical outer sleeve, comprising the steps of:

inserting the inner sleeve into the outer sleeve from an one end opening of the outer sleeve which has a slit formed therein and extending toward an one end from an other end thereof and at least the other end portion of the outer sleeve includes a tapered part having an inside diameter gradually reduced from the one end side to the other end, said inner sleeve including a tapered part having an outside diameter following the inside diameter of the tapered part of the outer sleeve and an expanded diameter part located on the other end side of said tapered part of the inner sleeve and having an outside diameter larger than the inside diameter of the other end of the outer sleeve;

moving said expanded diameter part of the inner sleeve in the outer sleeve with forcibly widening the slit of said outer sleeve; and projecting said expanded diameter part from an other end opening of the outer sleeve to engage a step part formed between the expanded diameter part of the inner sleeve and the tapered part of the inner sleeve with an end surface of the other end opening of the outer sleeve.

2. An attaching structure for attaching an inner sleeve to an inside of a cylindrical outer sleeve, wherein the outer sleeve has a slit formed therein and extending toward an one end from the other end thereof, and at least the other end portion thereof includes a tapered part having an inside diameter gradually reduced from the one end side to the other end;

the inner sleeve includes a tapered part having an outside diameter following the inside diameter of the tapered part of said outer sleeve and an expanded diameter part located on the other end side of said tapered part of the inner sleeve and having an outside diameter larger than the inside diameter of the other end of the outer sleeve; and the inner sleeve is inserted into the outer sleeve from an one end opening of the outer sleeve, the expanded diameter part thereof passes through the outer sleeve with forcibly widening the slit of the outer sleeve to project from an other end opening of the outer sleeve, and a step part formed between the expanded diameter part of the inner sleeve and the tapered part of the inner sleeve is engaged with an end surface of the other end opening of the outer sleeve.

* * * * *